US007934861B2

(12) United States Patent
Albou

(10) Patent No.: US 7,934,861 B2
(45) Date of Patent: May 3, 2011

(54) MOTOR VEHICLE HEADLIGHT MODULE FOR A CUTOFF BEAM

(75) Inventor: Pierre Albou, Paris (FR)

(73) Assignee: Valeo Vision, Bobigny (FR)

( * ) Notice: Subject to any disclaimer, the term of this patent is extended or adjusted under 35 U.S.C. 154(b) by 473 days.

(21) Appl. No.: 11/958,667

(22) Filed: Dec. 18, 2007

(65) Prior Publication Data

US 2008/0151567 A1 Jun. 26, 2008

(30) Foreign Application Priority Data

Dec. 20, 2006 (FR) ..... 06 11153

(51) Int. Cl.
*F21V 5/04* (2006.01)

(52) U.S. Cl. ..... 362/539; 362/538; 362/507

(58) Field of Classification Search ..... 362/297, 362/299, 300, 308, 309, 460, 487, 507, 516, 362/520, 521, 522, 538, 539, 545
See application file for complete search history.

(56) References Cited

U.S. PATENT DOCUMENTS

| | | | | |
|---|---|---|---|---|
| 6,997,587 | B2 | 2/2006 | Albou | |
| 7,097,334 | B2 * | 8/2006 | Ishida et al. | 362/516 |
| 7,134,775 | B2 * | 11/2006 | Oishi et al. | 362/545 |
| 7,168,836 | B2 | 1/2007 | Tatsukawa | |
| 7,255,467 | B2 * | 8/2007 | Ishida et al. | 362/520 |
| 7,311,430 | B2 * | 12/2007 | Tsukamoto et al. | 362/545 |
| 2003/0202359 | A1 | 10/2003 | Albou | |
| 2005/0219856 | A1 | 10/2005 | Tatsukawa | |
| 2006/0002130 | A1 | 1/2006 | Albou | |

FOREIGN PATENT DOCUMENTS

| | | | |
|---|---|---|---|
| DE | 3311762 | A1 | 10/1984 |
| DE | 10308703 | A1 | 11/2004 |
| DE | 102005020085 | A1 | 11/2006 |
| EP | 1357334 | A1 | 10/2003 |
| EP | 1610057 | A1 | 12/2005 |
| FR | 2789474 | A1 | 8/2000 |
| FR | 2868510 | A1 | 10/2005 |
| FR | 2872257 | A1 | 12/2005 |

* cited by examiner

*Primary Examiner* — Hargobind S Sawhney
(74) *Attorney, Agent, or Firm* — Jacox, Meckstroth & Jenkins

(57) ABSTRACT

A motor vehicle headlight module giving a beam with cutoff, comprising a concave reflector, a light source disposed in the concavity of the reflector, and a lens situated in front of the reflector and light source. The source is formed by at least one light emitting diode for illuminating at least upwards. The reflector is associated with a bender the top face of which is reflective in order to bend the beam coming from the reflector, the bender comprising a front end edge able to form the cutoff in the lighting beam. The exit surface of the lenses chosen so as to be able to be connected on a continuous surface with the exit surfaces of the lenses of adjacent modules. In addition, the mid-line of the lens is formed by a skew curve arc, and a correcting optical system is provided between the reflector and the lens for obtaining a satisfactory cutoff line, according in particular to the geometry of the entry face and exit face of the lens.

20 Claims, 5 Drawing Sheets

MOTOR VEHICLE HEADLIGHT MODULE FOR A CUTOFF BEAM

BACKGROUND OF THE INVENTION

1. Field of the Invention

The invention relates to a motor vehicle headlight module giving a cutoff beam, this module comprising a concave reflector, a light source disposed in the concavity of the reflector and a lens situated in front of the reflector and light source. The source is formed by at least one light emitting diode in order to illuminate at least upwards. The reflector is associated with a bender, the top face of which is reflective in order to bend the beam coming from the reflector. The bender comprises a front end edge able to form the cutoff in the light beam. The module is such that the exit surface of the lens is chosen so as to be able to be connected along a continuous surface with the exit surfaces of the lenses of adjacent modules.

2. Description of the Related Art

The patent FR 2 872 257, corresponding to U.S. Patent Publication 2006002130, shows lighting modules of this type that, by juxtaposition of the ends of the exit lenses, produce a headlight, the whole exit surface of which is continuous and smooth and has a toric appearance. However, the mid-line of the lenses of these headlights is situated in one plane, that is to say the mid-line extends in two dimensions only, and cannot be a skew line extending in three dimensions. In addition, such headlights make it possible to obtain only a flat cutoff in the beam.

Changes in the style of vehicles results in headlights having casings provided with glasses, the surface of which admits a skew curve as a mid-line. It is desirable, in particular for style, for the lens of the headlight, disposed in the casing behind such a glass, to follow the skew curvature of the glass as far as possible.

The lighting modules known at the present time do not make is possible to have an exit lens that substantially follows a skew curve while producing a satisfactory light beam, in particular with regard to the cutoff.

SUMMARY OF THE INVENTION

One object of the invention is in particular to provide a lighting module for a motor vehicle headlight of the type defined above, which comprises an exit lens following a skew curve, having a curvature both in plan view and front view, and which gives a beam with a satisfactory cutoff.

Another object of the invention is to provide such a lighting module that makes it possible to produce, by assembling several modules, a dipped headlight, in particular comprising a PBL function (the abbreviation for the English term "Progressive Bending Light", standing for progressive bending dipped light), that is to say a function providing progressive illumination on a bend.

It is also desirable for the lighting module to remain economical to manufacture.

According to the invention, a headlight module as defined previously also has the following features:

- the mid-line of the lens is formed by an arc of a skew curve (constituting for example an approximation of a segment of a skew mid-line of a curve of the vehicle), and
- a correcting optical system is provided between the reflector and the lens in order to obtain a satisfactory cutoff line according to the geometry of the entry face and exit face of the lens.

In the remainder of the present text, the terms "vertical" and "horizontal" relate to the positioning of the module once mounted in the headlight, itself mounted in the vehicle. It is possible to depart slightly from a verticality or horizontality described in the strict sense of the word while remaining within the spirit of the present invention.

Preferably, the exit face of the lens is obtained by making a forwardly convex arc situated in vertical planes slide along the arc of a skew curve.

Preferably again, the entry face of the lens is obtained by a sliding, similar to that of the exit face, of a second arc of a curve calculated so that the lens is stigmatic between a point situated at the rear of the top of the lens on the optical axis of the lens, this in a two-dimensional construction, identical in all the parallel vertical planes containing the curves, and infinity.

Preferably the arc of a skew curve constituting the approximation of a segment of the mid-line is seen from above on an arc of a circle and is seen from the front on another arc of a circle. Each arc of a circle is an approximation of the plan view and front view of the segment of the mid-line of the curve of the vehicle and admits the same tangents at the ends. The angular extent of an arc of a circle constituting the approximation of a segment is preferably no more than 90°.

Advantageously, the forwardly convex arc that is made to slide in order to obtain the exit face of the lens is an arc of a circle situated in a vertical plane. The vertical plane of the successive arcs of the circle can either remain parallel to itself and orthogonal to the transverse direction, or rotate about a point.

For a beam with a flat cutoff, the module comprises a bender with a front edge in an arc of a circle, the reflector is determined so as to give a wave surface along this line in an arc of a circle, and the correcting optical system is formed by an optical blade, the exit face of which is formed by a cylinder of vertical axis, while the entry face of the correcting optical blade is calculated so that the optical path between the circular edge of the bender and a cylindrical exit wave surface is constant.

For a beam with a V-shaped cutoff, in particular with a horizontal arm and a rising arm inclined at 15°, the module comprises a bender with a V-shaped rectilinear edge close to the optical axis, the exit wave surfaces are formed by planes orthogonal to optical axis, and the correcting optical system is formed by a correcting lens, the entry face of which is calculated so that the optical path between the second focus of the electrical reflector and the exit wave surface is constant.

The forwardly convex arc that is made to slide in order to obtain the exit face of the lens is advantageously an arc of a circle situated in a vertical plane. The vertical plane of the successive arcs of a circle can remain parallel to itself and orthogonal to the transverse direction.

The vertical plane of the successive arcs of the circle can also be perpendicular to the projection of the arc of a skew curve on a horizontal plane (in plan view).

According to one embodiment, in order to obtain a beam with a flat cutoff, the module comprises a bender with a front edge in an arc of a circle, the reflector is determined do as to give a wave surface along this line in an arc of a circle, and the correcting optical system is formed by an optical blade, the exit face of which is formed by a cylinder of vertical axis, while the entry face of the optical blade is calculated so that the optical path between the circular edge of the bender and a cylindrical exit wave surface is constant.

According to another embodiment, in order to obtain a beam with a V-shaped cutoff, the module comprises a bender with a V-shaped rectilinear edge close to the optical axis, and the correcting optical system is formed by a correcting lens, the entry face of which is calculated so that the optical path between the second focus of the elliptical reflector and the exit wave surface is constant.

The invention also relates to a motor vehicle headlight giving a beam with cutoff, in particular a dipped headlight or a fog light, and which comprises at least two lighting modules as defined previously and juxtaposed so that the exit surface of the headlight is smooth and continuous in a skew shape.

A dipped headlight is advantageously produced with at least one lighting module as defined previously and producing V-shaped cutoff, this module being disposed on the same side as the longitudinal axis of the vehicle, and with at least one module with a flat cutoff juxtaposed towards the outside of the module with a V-shaped cutoff.

The dipped headlight can comprise several juxtaposed modules with a V-shaped cutoff on the same side as the longitudinal axis of the vehicle, followed towards the outside by several modules with a horizontal cutoff. In particular it is possible to provide four modules with a V-shaped cutoff towards the inside and four modules with a flat cutoff towards the outside, that is to say in all eight modules for the headlight. The control of the lighting of the modules can be slaved to the steering angle of the vehicle, so that the modules with a horizontal cutoff situated towards the outside are progressively switched on when the vehicle follows a bend, on the inside of which the headlight in question is situated.

The invention consists, apart from the provisions disclosed above, of a certain number of other provisions that will be dealt with more explicitly below with regard to example embodiments described with reference to the accompanying drawings, but which are in no way limitative.

These and other objects and advantages of the invention will be apparent from the following description, the accompanying drawings and the appended claims.

DESCRIPTION OF THE PREFERRED EMBODIMENTS

Figure 1:
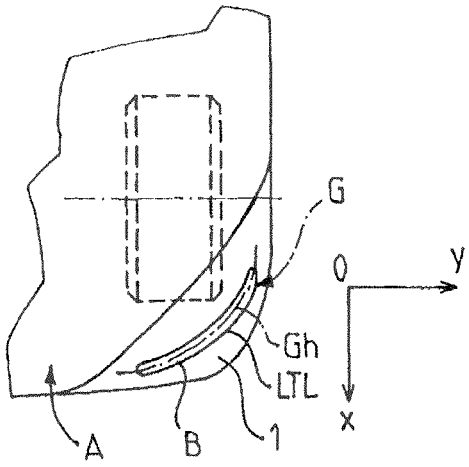
FIG. 1 is a schematic plan view of the left-hand front external edge of a vehicle with a headlight according to the invention.
Figure 2:
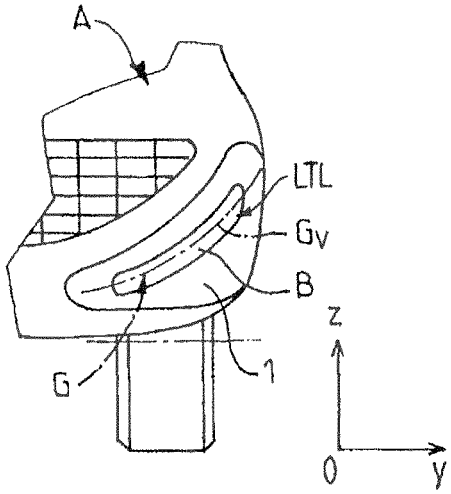
FIG. 2 is a schematic front view of the left-hand front edge of FIG. 1 and of the headlight.

Referring to FIGS. 1 and 2, it is possible to see the left-hand front end of a vehicle A provided with a headlight B according to the invention, the exit lens LTL of which follows a skew curve G substantially parallel to the skew mid-line (that is to say in three dimensions) of the glass 1 of the headlight B, in order to be consistent with the style of the motor manufacturer.

The skew curve G seen from above (FIG. 1) has an arched shape Gh. This same skew curve G seen from the front (FIG. 2) also has an arched shaped Gv, generally different from the arched shape Gh.

FIGS. 1 and 2 show in each projection plane a system of orthogonal axes. In the horizontal plane, the axis Ox is parallel to the longitudinal direction of the vehicle while the axis Oy corresponds to the transverse direction. The axis Oz corresponds to the vertical direction.

The size of the casing of the headlight B in the direction Ox (FIG. 1) is limited because of the automobile construction imperatives. As a result the light source is relatively close to the glass 1, which risks being subjected to excessive heating. This would be the case in particular with the glass 1 produced from a transparent plastics material and if the light source were of the halogen lamp type. To avoid such difficulties, the light source is formed by at least one light emitting diode.

Figure 16:
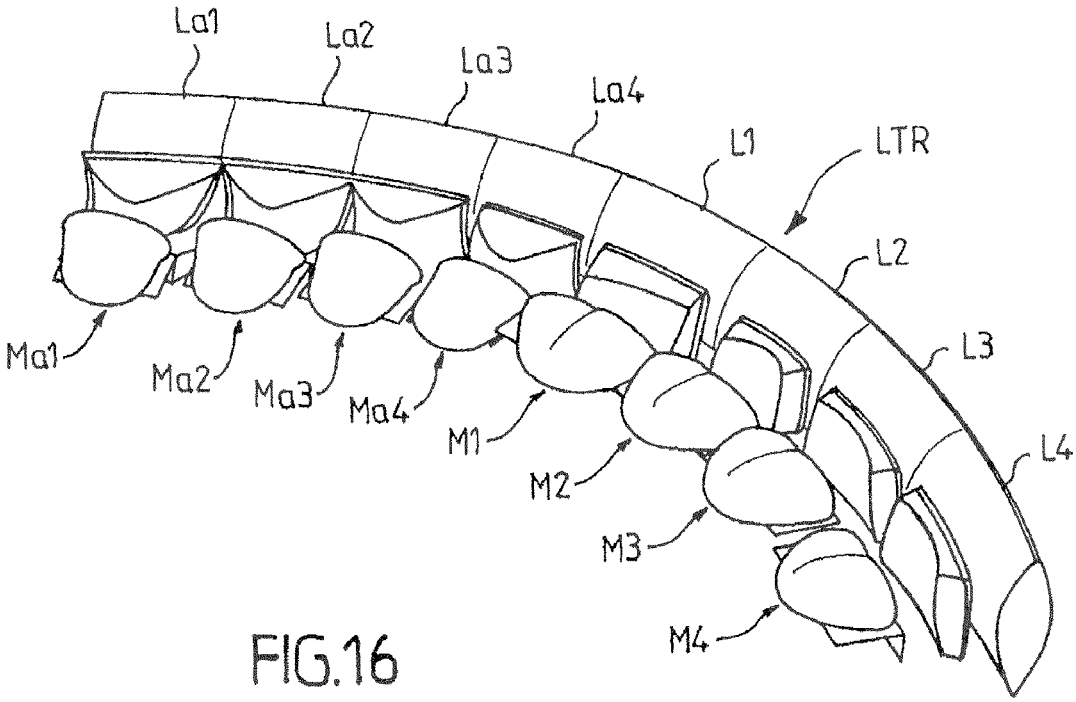
FIG. 16 is a perspective view from above and the rear of a dipped headlight, on the right-hand side of a vehicle, composed of eight modules according to the invention juxtaposed.
Figure 17:
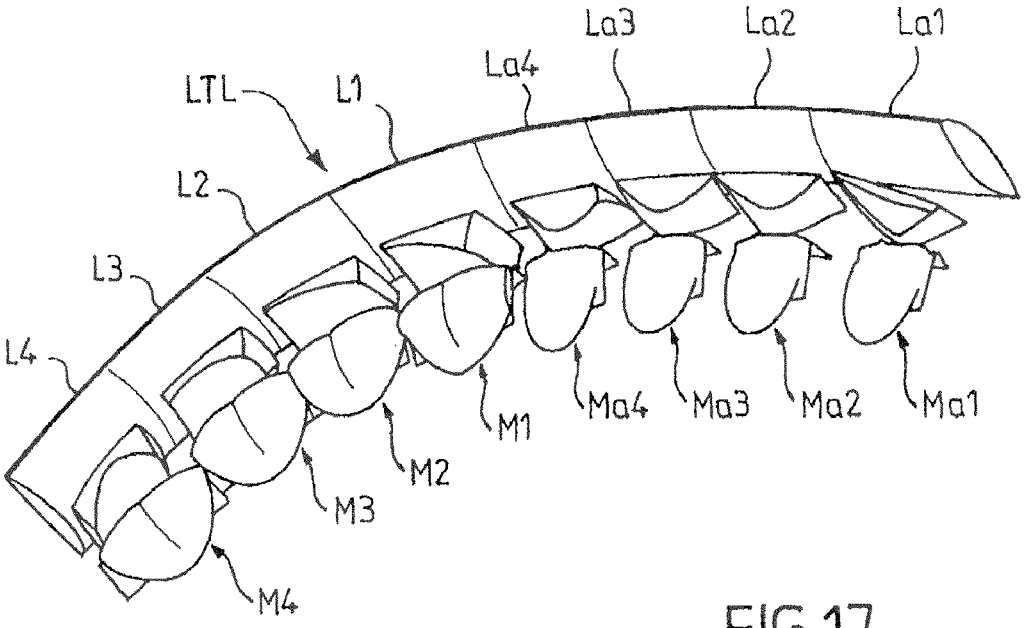
FIG. 17 shows, similarly to FIG. 16, the dipped headlights situated on the left-hand side of the vehicle.

The headlight B is composed of several modules M, Ma juxtaposed, as explained more completely with regard to FIGS. 16 and 17.

Figure 5:
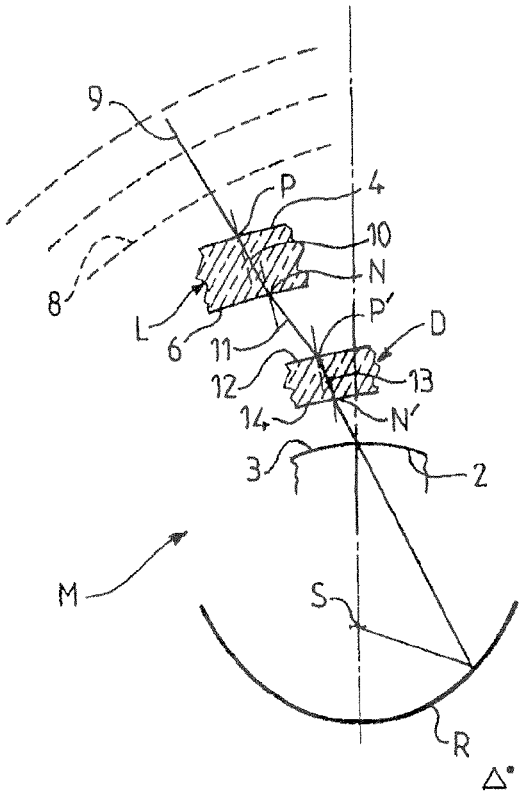
FIG. 5 is a schematic plan view illustrating the determination of the correcting optical system in the case of a module with flat cutoff and with a bender with a circular edge.

FIG. 5 illustrates schematically the headlight module M according to the invention, giving a beam with flat cutoff. This module M comprises a concave reflector R of the type described in the aforementioned patent FR 2 872 257, and a light source S formed by at least one light emitting diode in order to illuminate at least upwards, this diode being situated in the vicinity of the first internal focus of the reflector R. The module M also comprises a blender 2, that is to say an essentially horizontal plate, the top face of which is reflective and the front edge 3 of which passes through, or close to, the second focus of the reflector R in order to create the cutoff line. According to FIG. 5 the front edge 3 of the bender consists of a forwardly convex arc of a circle.

The expressions "front" and "rear" are to be understood according to the direction of propagation of the light returned by the reflector R.

The reflector R is determined so as to transform the spherical wave surface coming from the source S into a wave surface merged with the front edge 3, so that the cutoff line of the beam is flat and horizontal.

Figure 6:
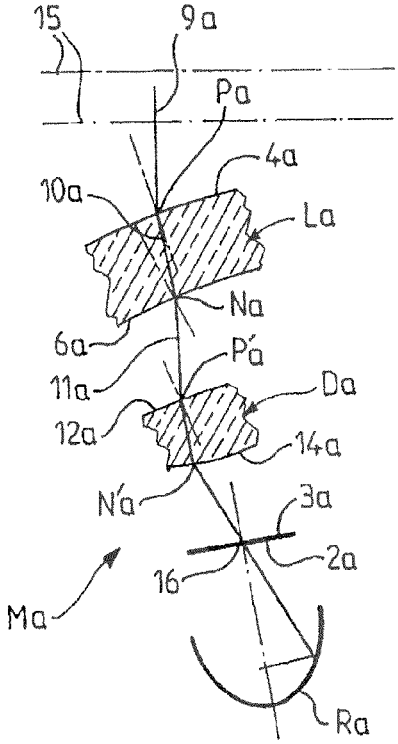
FIG. 6 is a diagram illustrating the determination of the correcting optical system in the case of a module with a V-shaped cutoff and with a bender whose front edge is situated in a vertical plane orthogonal to the optical axis of the reflector.
Figure 7:
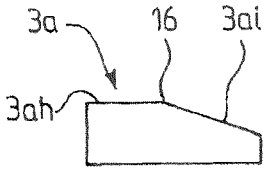
FIG. 7 is a front view of the bender of FIG. 6.

FIG. 6 illustrates schematically a headlight module Ma according to the invention, with a reflector Ra of the ellipsoid type or, for simplification, referred to as of the elliptical type, giving a beam with a V-shaped cutoff. The front edge 3*a* of the bender 2*a* is situated in a vertical plane orthogonal to the axis of the reflector Ra, the front edge 3*a* passing through the second focus of the reflector. The front edge 3*a* of the bender has a V shape in the vicinity of the optical axis (FIG. 7), corresponding to the cutoff required for the beam.

A lens L (FIG. 5), La (FIG. 6) is situated in front of the reflector and light source.

As disclosed with regard to FIGS. 1 and 2, it is wished for the whole exit lens of the headlight LTL for the left-hand side or LTR for the right-hand side to have a continuous curved external surface along the skew mid-line of the contour of the glass of the headlight B. It is also wished, in a headlight consisting of several juxtaposed modules, for the successive exit lenses L, La of the juxtaposed modules to be connected along a continuous line in order to give a whole lens LTL or LTR having a smooth exit surface.

The entry surface of the whole lens LTL, LTR and the entry surface of the juxtaposed lenses L, La of modules must be smooth in order to avoid parasitics such as bright lines, or the like, between the successive lenses of the juxtaposed modules. In addition, it must be able to produce a dipped beam with a V-shaped cutoff having a horizontal branch and an inclined branch rising at 15°.

Figure 3:
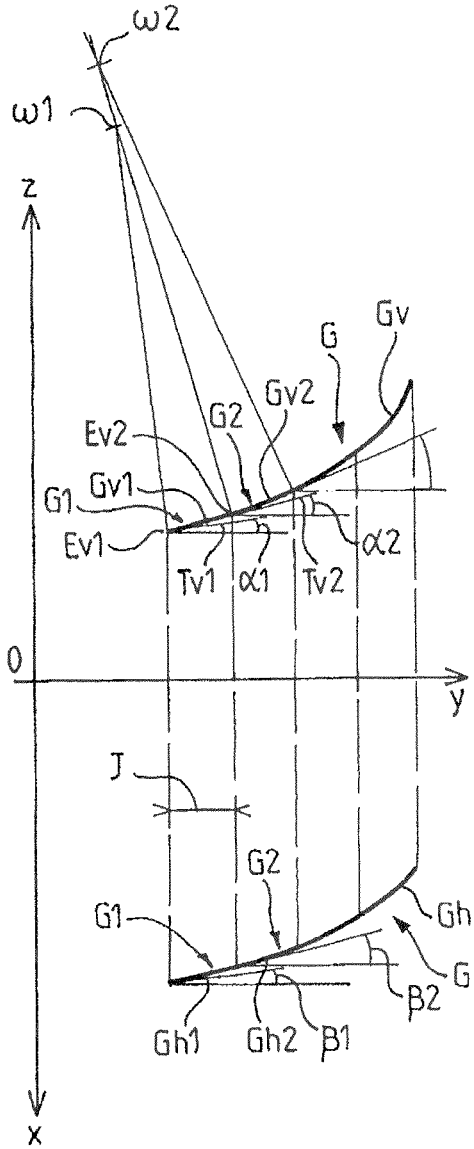
FIG. 3 is a drawing to a larger scale of the projections onto a vertical plan and onto a horizontal plane of the skew mid-line of the curve of the glass of the headlight.

FIG. 3 illustrates, to a larger scale than in FIGS. 1 and 2, the front view Gv and the plan view Gh of the mid-line of a headlight B to be produced with a set of modules according to the invention.

For the construction of the modules composing the headlight, the line G is notionally divided into successive segments G1, G2, . . . projected onto a transverse vertical plane in segments Gv1, Gv2 . . . and onto a horizontal plane in segments Gh1, Gh2 . . . Each segment G1, G1 . . . corresponds to a module M1, M2 . . . and to a diode of the associated module.

For each projected segment thus determined, the ends, for example Ev1 and Ev2 for the segment Gv1, and the tangents Tv1, Tv2 to these ends, are considered. The tangents form, with the horizontal direction parallel to the direction Oy, angles $\alpha$ 1, $\alpha$2.

For the construction of the exit lens of the module M1 corresponding to the arc G1, an approximation of the segment Gv1 is established by an arc of the circle having an end E'v1, the end of the previous segment, known from the approximation of Gv, and an end E'v2 situated at a distance y from E'v1 equal to the following distance between Ev1 and Ev2, and admitting the same tangents Tv1, Tv2 at these two ends. The centre of this arc of a circle is a point $\omega$ 1; the angular extent of the arc of a circle is preferably less than or equal to 90°. The following segment Gv2 is approximated in the same way by an arc of a circle starting from the point E'v2 and ending at an end with the same measurement along y as Gv2 with the same tangents at the two ends, and so on for the whole of the curve Gv that is replaced by a succession of arcs of the circle very close to the real curve (if the first end E'vx coincides with Ev1, the ends E'vn move away further and further from Evn in general when n increases).

The same procedure is followed for the horizontal projection Gh. The pitch J in the direction Oy of the successive segments may be regular or may vary in order to take account of the change in curvature of the line.

The skew curved mid-line that is seen in front and plan view on the two arcs of a circle constituting the approximations of Gv1 and Gh1 is designated $\Gamma$ (FIG. 1). The curve $\Gamma$ is the directing line of the exit face 4 of the lens.

To produce the smooth exit face 4 (FIG. 4) of the lens L an arc of a forwardly convex curve 5 situated in a vertical plane is made to slide along the mid-line $\Gamma$. The curvature of the arc of the convex curve 5 makes it possible to avoid reflections. Preferably the arc of a convex curve 5 is an arc of a circle that delimits an angular sector, a point on which, for example the middle of the chord subtending the arc of a convex curve 5, moves along the curve $\Gamma$.

According to a first possibility, the plane of the arc of a convex curve 5 remains parallel to itself during the movement and orthogonal to the transverse direction Oy. According to another possibility, the plane of the arc of a circle is substantially perpendicular to the projection of the curve $\Gamma$ in the plane (O,x,y) and therefore turns about a vertical axis passing through the centre of the circle serving as an approximation for the segment Gh.

The smooth entry face 6 (FIG. 5) of the lens L, that is to say the face turned towards the source S, is obtained by making an arc of a curve 7 (FIG. 4) of appropriate shape slide over the mid-line $\Gamma$ in a manner similar to the arc of a convex curve 5 of the entry face.

The equation of the curve $\Gamma$ can be determined from the known points on the curve G and the choice of the arcs of a circle Gv1 . . . Gh1. This equation makes it possible to calculate a lens L, La for the following module, continuous with the previous one and in tangency continuity with it.

Calculation of the Exit Face 4

A vertical exit profile in an arc of a convex curve 5 is considered, of radius r, which results in a toric exit face if $\alpha$1=$\alpha$2 and cylindrical if, in addition, $\beta$1=$\beta$2 (FIG. 3). $\beta$1 and $\beta$2 are the angles formed with the transverse direction Oy by the tangents to the ends of the horizontal projection Gh1 of the segment of a curve in question.

The equation of the smooth exit face 4 can then be established for the equation of the curve $\Gamma$, of radius r of the arc of the convex curve 5 and the relative position of this arc with respect to the curve $\Gamma$.

Figure 4:
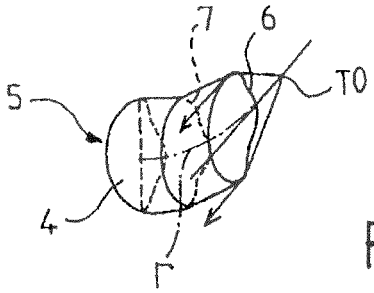
FIG. 4 is a diagram in perspective illustrating the construction of the exit lens of the module.

To determine the smooth entry face of the lens, in a vertical plane perpendicular to the direction Oy, a profile of an arc of a curve 7 is sought corresponding to a stigmatic lens between a point T0, situated behind the top of the lens, as illustrated by the diagram in FIG. 4, and infinity (construction in one of the vertical planes containing the exit arc of a circle as explained above.

A correcting optical system D (FIG. 5) or Da (FIG. 6) is provided between the reflector R, Ra and the lens L, La for obtaining a satisfactory cutoff line in the light beam.

Correcting Optical System for a Flat Cutoff

A module according to FIG. 5 is considered, the reflector assembly R and bender 2 of which generate a toric wave issuing from the front edge 3 of the bender 2. The reflector R is determined so as to transform a spherical wave surface coming from the source S into a wave surface reduced to the arc of a circle situated in the plane of the horizontal plate forming the bender 2.

A correcting optical system D is calculated, placed between the exit lens L defined above and the front edge 3 of the bender so that the toric wave coming from the edge 3 of the bender is transformed into a cylindrical wave surface 8 of vertical axis, the traces of which on the horizontal plane are concentric circles (FIG. 5), of vertical axis $\Delta$. The position of this axis $\Delta$ is variable: it is a parameter for adjusting the horizontal spread of the light beam, and possibly creating a horizontal shift of its mean direction.

For the calculation, any point P is considered on the exit surface of the lens L. A light ray issuing from this point and belonging to the required cylindrical exit wave is carried by a straight line passing through P, intersecting the vertical axis $\Delta$ of the cylindrical wave and perpendicular to this axis. The equation of the supporting straight line of the light ray 9 can then be determined by taking account of the coordinates of the point P.

The optical path traveled in the air between the cylindrical wave surface 8 and the point P situated on the exit face can then be determined.

Next the ray 9 is extended in the reverse direction to that of the propagation of the light.

The equation of the exit face 4 of the lens L having been established previously, the normal to this surface P can be calculated. Knowing the refractive index N of the lens L, it is possible to determine the direction of the refracted ray 10 in the thickness of the lens L, corresponding to the ray 9. The point N of intersection of the ray 10 with the entry face 6 of the lens L is determined. Next the normal to the entry face 6 at point N and the refracted ray 11 in reverse propagation in the air that separates the lens L from the correcting system D are determined.

It is assumed that the exit face 12 of the intermediate correcting optical system D is cylindrical, of vertical axis encountering the axis of symmetry of the reflector (which is not necessarily the longitudinal axis Ox of the vehicle). This exit face 12 is a "free" dioptre, the choice of which is arbitrary, the surface then being able to be modified in order to optimize the sharpness of the cutoffs, by means of optimization software (which does not modify the remainder of the construction, but simply changes the equation giving P' and the normal at P').

Then the intersection P' of the ray 11 with the exit face 12 is calculated, along with the normal to the exit face 12 at point P'. The refracted ray 13 within the optical system D is derived from this.

Next the point N of intersection of the ray 13 and the entry face 14 of the correcting system D is sought. For this purpose, the optical equation representing the constancy of the optical path between the cylindrical wave surface from which come the ray 9 and the front edge 3 of the bender is written.

By evaluating the optical path for a central point of the exit face 4 of the exit lens L, it is possible to calculate the constant by having fixed the thickness close to the centre of the correcting optical blade, and therefore the coordinates of the point N', and to determine the unknown surface constituting the entry face 14 of the correcting optical system D by making the point P vary.

Correcting Optical System for V-Shaped Cutoff

In this case, the reflector is determined so that the exit wave is a flat wave, the flat trace wave surfaces 15 of which on a horizontal plane passing through the optical axis are straight lines (FIG. 6) parallel to each other and perpendicular to the longitudinal axis of the vehicle.

The front edge 3*a* of the bender is situated in a plane orthogonal to the axis of the reflector Ra. This front edge 3*a* seen in front view has a V shape (FIG. 7) inverted with respect to the required cutoff line in the vicinity of the optical axis. The front edge 3*a* is formed by a horizontal arm 3*ah* and an arm 3*ai* inclined at 15° to the horizontal. The central point 16 of the edge of the bender, corresponding to the apex of the inverted V, is situated on the geometric axis of the reflector Ra, which can form an angle with the longitudinal axis of the vehicle.

The flat exit wave having as its traces the flat trace wave surfaces 15 corresponds to the transformation by the correcting optical system Da and the exit lens La of a spherical wave issuing from the central point 16 of the edge of the bender. The correcting optical system Da is formed by a correcting lens. The exit lens La and the correcting lens Da are equivalent to a stigmatic lens between a point and infinity, in particular equivalent to a lens such as the ones used in elliptical lighting modules. However, the exit face of the lens La is very different from the exit face of a conventional elliptical module, and gives rise to a unique style. The free dioptre corresponding to the exit face 12*a* of Da affords an optimization of the sharpness of the cutoff when moving away from the focus. The determination of the exit faces 12 or 12*a* for optimizing the sharpness of the cutoffs can be effected by means of software.

In order to determine the entry face 14*a* of the correcting lens Da (FIG. 6), a similar procedure to that described with regard to FIG. 5 is followed. The same numerical or literal references have been repeated followed by the letter "a" and the description will not be repeated in detail. A ray 9*a* is still considered, propagating it in the reverse direction of the light. The ray 9*a* is perpendicular to the flat trace wave surfaces 15, that is to say the ray 9*a* is parallel to the longitudinal axis of the vehicle. The distance from the point N'a to the central point 16 situated at the second focus of the elliptical reflector Ra can be calculated according to parameters. By writing the constancy of the optical path between the central point 16 and a flat trace wave surface 15, it is possible to determine the coordinates of the point N'a and the equation of the entry face 14*a*.

Figure 8:
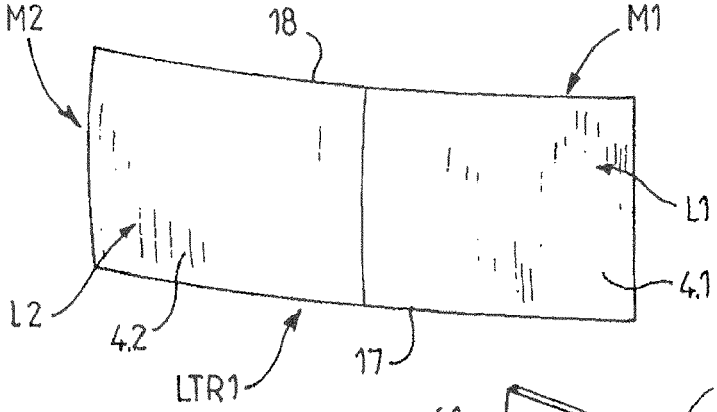
FIG. 8 is a front view of a headlight situated on the right-hand side of the vehicle and comprising two modules with a flat cutoff according to the invention, juxtaposed.

Referring to FIG. 8, it is possible to see, in front view, a headlight for the right-hand side of a vehicle, composed of two juxtaposed modules M1, M2, with flat cutoff according to FIG. 5. The exit faces 4.1 and 4.2. are connected continuously in order to form a whole lens LTR1 with a smooth exit face. The bottom edge 17 and the top edge 18 of the exit face are not in a horizontal plane, but have an arched shape in front view, the left-hand end of one edge being higher than the right-hand end.

Figure 9:
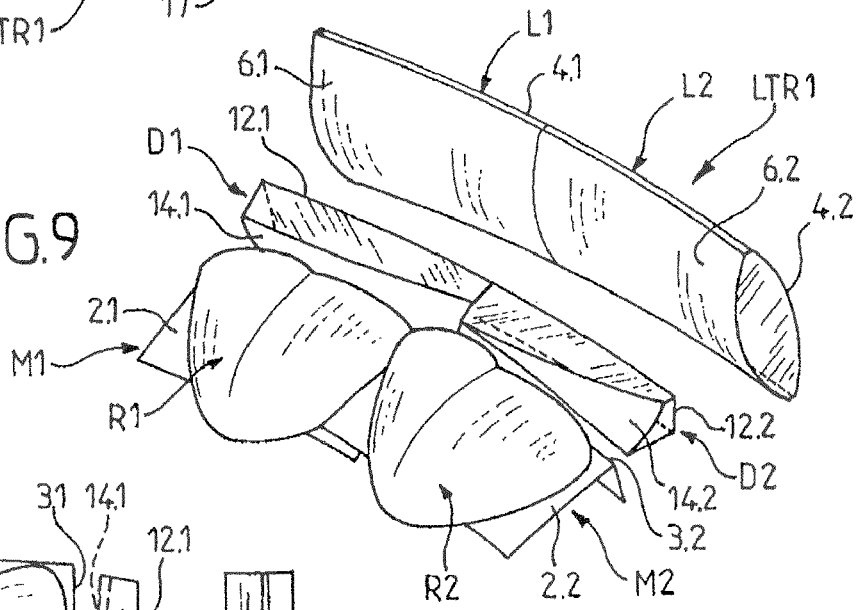
FIG. 9 is a perspective view from above and from the rear of the optical elements of the headlight at FIG. 8.

FIG. 9 is a perspective view of the rear of the two modules M1, M2 juxtaposed so as to give the exit face a FIG. 8. The exit lenses L1, L2 are in line with each other, the entry face of these lenses 6.1., 6.2. admitting a cross-section through a longitudinal vertical plane in the form of a convex arc turning its convexity towards the rear, while the cross-sections of these faces through horizontal planes correspond to arcs of a curve turning their concavity towards the rear.

The intermediate correcting systems D1, D2 have a cylindrical exit face 12.1, 12.2 of vertical axis. The entry faces 14.1, 14.2 have a relatively complex shape corresponding substantially to the one obtained by twisting a rectangular band. The twisting appears in FIG. 10, in plan view.

The reflectors R1, R2, seen from above, have two half shells connected in a longitudinal vertical mid-plane on a hollow area, forming a kind of valley. The bender 2.1, 2.2 has a front edge 3.1, 3.2 in an arc of a circle with a large radius.

Seen in front view (FIG. 8) and seen from above, (FIG. 10), the exit face of the whole lens LTR 1 of the headlight has a mid-line in the form of a arc of a curve.

Figure 10:
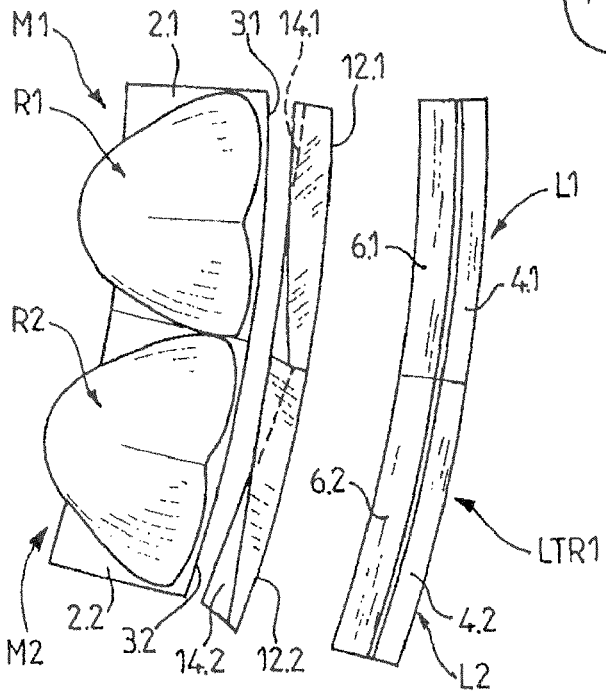
FIG. 10 is a plan view of the headlight at FIG. 9.
Figure 11:
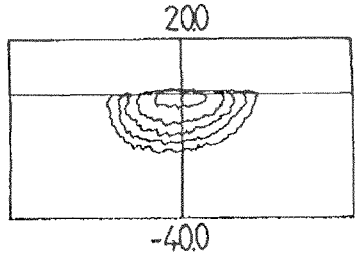
FIG. 11 is a diagram of the network of isolux curves obtained with the headlight of FIGS. 9 and 10.

FIG. 11 shows the network of isolux curves obtained with a headlight like the one in FIG. 8 to FIG. 10. The light beam has a horizontal cutoff line.

Figure 12:
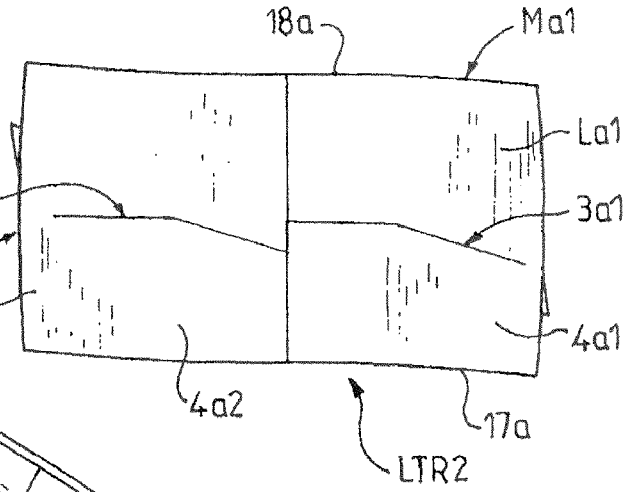
FIG. 12 is a front view of a headlight according to the invention obtained by the juxtaposition of two lighting modules with a V-shaped cutoff.

FIG. 12 shows in front view a vehicle headlight consisting of two modules Ma1, Ma2 giving a beam with a V-shaped cutoff at 15° for traffic on the right. The exit faces (4*a*1 and 4*a*2) of the whole lens LTR2 of the headlight, formed by the juxtaposition of the lenses La1, La2, has a bottom longitudinal edge 17*a* and a top longitudinal edge 18*a* with a double S-shaped curvature, the left-hand end of the transverse edges being situated at a higher level than that of the right-hand end. Each longitudinal edge has a change of direction between its ends. FIG. 12 shows the edges 3*a*1, 3*a*2 of the benders seen in front view.

Figure 13:
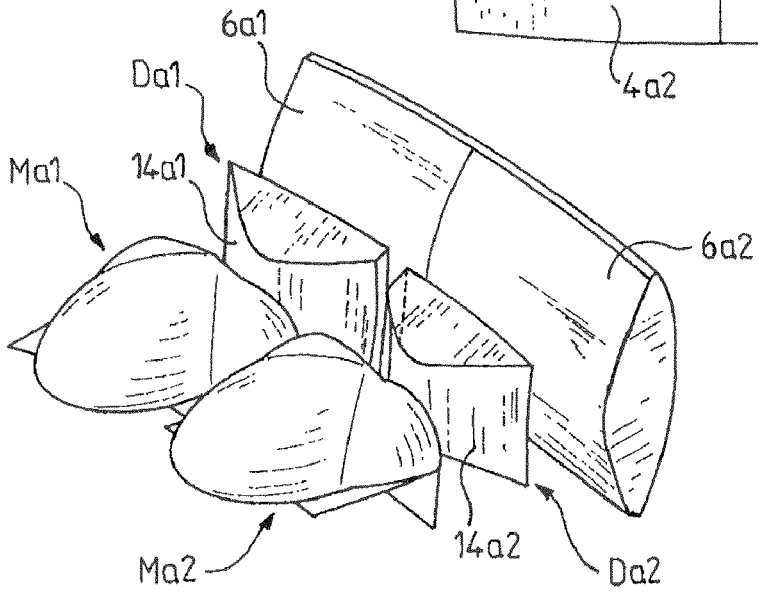
FIG. 13 is a perspective view from the rear and above of the headlight according to FIG. 12.

FIG. 13 shows in perspective, from the rear and above, the two juxtaposed modules Ma1, Ma2 of the headlight of FIG. 12. The entry faces 6*a*1, 6*a*2 of the exit lenses La1, La2 admit, in section through a longitudinal vertical plane, a line with a curved section convex towards the rear while the cross-section of these faces through a horizontal plane gives a line with a curved section concave towards the rear, visible in FIG. 13.

The entry faces 14*a*1, 14*a*2 of the correcting lenses Da1, Da2 admit, in horizontal cross-section, an arc of a curve convex towards the rear turning its apex towards the corresponding reflector. The cross-section of these faces 14*a*1, 14*a*2 through longitudinal vertical planes is formed by slightly arched segments, close to rectilinear segments. The cross-sections in the longitudinal vertical plane passing through the geometric axis of the reflectors correspond to arcs of a curve convex towards the reflector. The convexity of the vertical sections of the faces 14*a*1, 14*a*2, towards the reflector decreases progressively on moving away from the vertical mid-plane, this complexity being able to be cancelled out and be transformed into a concavity. The exit face 12*a*1, 12*a*2 of the correcting lenses is a cylindrical surface with vertical generatrices.

The reflectors Ra1, Ra2 comprise a main part in an ellipsoidal shape and, towards the front, on each side of the vertical mid-plane, two curved surfaces, concave towards the bottom, with a substantially triangular contour 19.1, 20.1 and 19.2, 20.2 terminating the elliptical reflector on each side in order to increase the light flux in the beam (essentially elliptical surfaces having foci close to those of the main section of the reflector would not send light into the "good" correcting lens and the corresponding rays would be lost or sources of stray rays, as spots in the beam in particular, in great width). The front edge of the surfaces 19.1 and 20.1 on the one hand and 19.2, 20.2 is situated in the vertical plane passing through the edge of the bender. The light emitting diodes constituting the light sources S are shown schematically at the internal focus of the reflector.

Figure 14:
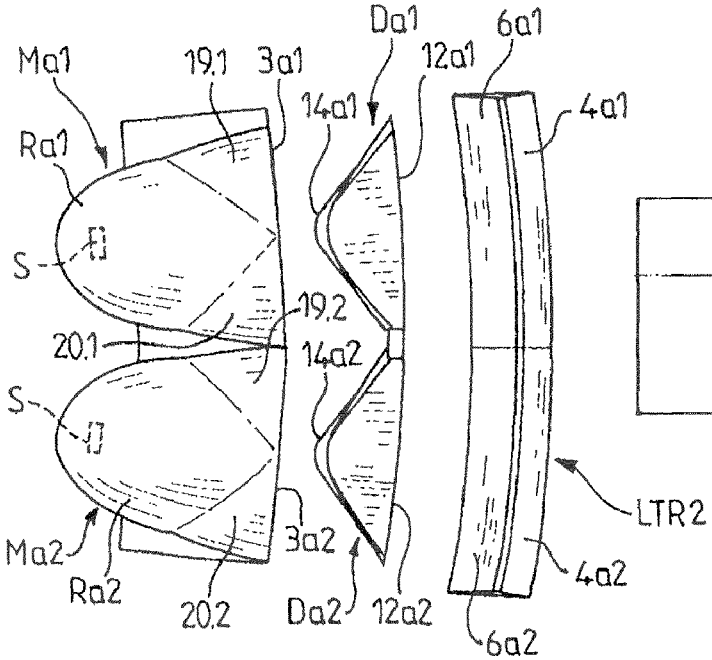
FIG. 14 is a plan view of the headlight of FIG. 13.
Figure 15:
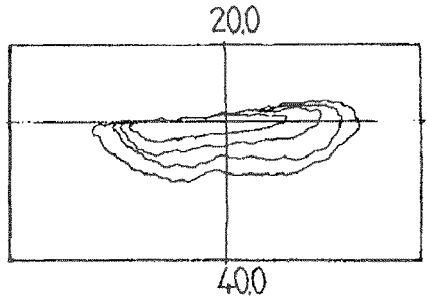
FIG. 15 is a diagram of the network of isolux curves obtained with the headlight of FIGS. 12 to 14.

FIG. 15 is the diagram of the isolux curves obtained with a headlight according to FIG. 12 to FIG. 14, with V-shaped cutoff.

FIG. 16 is a perspective view from above and the rear of a dipped headlight, for the right-hand side of a vehicle, consisting of eight modules according to the invention, juxtaposed so that the exit face, which is comprised of lenses La1 to La4 and L1 to L4, of the whole lens LTR is smooth and continuous. The lens LTR follows a skew line that rises from the end situated on the same side as the longitudinal axis of the vehicle towards the other end situated towards the outside. In plan view and front view, the lens LTR is arched and convex towards the outside.

The headlight comprises:

towards the inside, four modules Ma1, Ma2, Ma3, Ma4 of the type described with regard to FIG. 6 and FIGS. 12 to 14, giving a beam with a V-shaped cutoff, and towards the outside, four modules M1-M4 of the type described with regard to FIG. 5 and FIGS. 8 to 11 giving a beam with a horizontal cutoff in order to illuminate to the side of the vehicle.

The headlight according to FIG. 16 can be of the PBL type, that is to say a progressive bending light, for example by controlling the successive switching on of the external modules M1-M4 according to the turning of the vehicle towards the inside of a right-hand bend.

FIG. 17 is a view similar to that in FIG. 16 of the dipped headlights situated on the left-hand side of the vehicle with a whole lens LTL. The four modules with a V-shaped cutoff line are found towards the inside and, towards the outside, the four modules with a horizontal cutoff line.

The invention makes it possible to produce a module with an exit lens with skewed curvature, giving a beam with cutoff, in particular in a V, whilst ensuring improved style. The exit lens can follow curves in three dimensions and is no longer limited to a curve in two dimensions. The whole of the headlight comprises a free dioptre affording optimizations with the conventional optical calculation means for improving the sharpness of the V-shaped cutoffs. The one (inclined plane) shown for Ma1 in FIG. 17 can in particular be mentioned. Using such a dioptre here makes it possible to reduce the thickness and to improve the efficiency of a collecting lens while optimizing the sharpness of the cutoff compared with a dioptre of the cylindrical type. The optical construction principle remains identical and is even simplified thereby (a straight line/plane intersection rather than a straight line/cylinder intersection).

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A motor vehicle headlight module for a cutoff beam, comprising:

a plurality of lamp modules, each of said plurality of lamp modules comprising:

a concave reflector;

a light source disposed in the concavity of said concave reflector;

a lens situated in front of said concave reflector and said light source and facing said light source and said concave reflector, said light source being formed by at least one light emitting diode for illuminating at least upwards; and a bender situated between the concave reflector and the lens, a top face of said bender is reflective in order to receive a beam of light from said light source and bend the beam coming from said concave reflector, said bender comprising a front end edge that provides the cutoff in the lighting beam, said plurality of lamp modules comprising at least one first module and at least one adjacent module, an exit surface of a lens of said at least one first module cooperating with exit surface of a lens of said at least one adjacent module to provide a substantially continuous surface, wherein:

a mid-line of the lens of said at least one first module and said lens of said at least one adjacent module is formed by an arc of a skew curve; and each of said plurality of lamp modules further comprising a correcting optical system is provided between the reflector and the lens for obtaining a satisfactory cutoff line, according to a geometry of an entry face and an exit face of the lens, said correcting optical system further being situated between said front end edge of said bender and said lens.

2. The motor vehicle headlight module according to claim 1, wherein the exit face of the lens is obtained by sliding, along the skew curve arc, a forwardly convex arc situated in vertical planes.

3. The motor vehicle headlight module according to claim 2, wherein the entry face of the lens is obtained by a sliding, similar to that of the exit face, of a second arc of a curve calculated so that the lens is stigmatic in each of said vertical planes between a point situated at a rear of the top of the lens on the optical axis and infinity.

4. The motor vehicle headlight module according to claim 2, wherein the forwardly convex arc that is made to slide in order to obtain the exit face of the lens is an arc of a circle situated in a vertical plane.

5. The motor vehicle headlight module according to claim 4, wherein the vertical plane of the successive arcs of a circle is perpendicular to the projection of the skew curve arc on a horizontal plane.

6. The motor vehicle headlight module according to claim 1, wherein the skew curve arc constituting the approximation of a segment of the mid-line is seen from above in an arc of a circle and is seen in front view in another arc of a circle, each arc of a circle being an approximation of the plan view and of the front view of the associated segment of the mid-line, and admitting the same tangents to the ends.

7. The motor vehicle headlight module according to claim 6, wherein an angular extent of said arc of said circle constituting the approximation of a segment is no more than 90°.

8. The motor vehicle headlight module according to claim 6, wherein the vertical plane of the successive arcs of a circle remains parallel to itself and orthogonal to the transverse direction.

9. The motor vehicle headlight module according to claim 1,wherein, for a beam with a flat cutoff, the module comprises a bender with a front edge in an arc of a circle, the reflector is determined so as to give a wave surface along this line in a arc of a circle, and the correcting optical system is formed by an optical blade, the exit face of which is formed by a cylinder of vertical axis, while the entry face of the optical blade is calculated so that the optical path between the circular edge of the bender and a cylindrical exit wave surface is constant.

10. The motor vehicle headlight module according to claim 1, wherein, for a beam with a V-shaped cutoff, said bender comprises a V-shaped rectilinear edge close to the optical axis, exit wave surfaces are formed by planes orthogonal to the optical axis, and the correcting optical system is formed by a correcting lens, the entry face of which is calculated so that the optical path between the second focus of the elliptical reflector and the exit wave surface is constant.

11. A motor vehicle headlight giving a beam with cutoff, a dipped headlight or a fog light, comprising at least two lighting modules according to claim 1, juxtaposed so that the exit surface of the headlight is smooth and continuous in a skew shape.

12. The dipped motor vehicle headlight according to claim 1, comprising at least one lighting module producing a V-shaped cutoff, this module being disposed on the same side as the longitudinal axis of the vehicle, and at least one module with a flat cutoff juxtaposed, towards the outside, with the module with a V-shaped cutoff.

13. The dipped motor vehicle headlight according to claim 1, comprising several juxtaposed modules with a V-shaped cutoff on the same side as the longitudinal axis of the vehicle, followed towards the outside by several modules with a horizontal cutoff.

14. The dipped motor vehicle headlight according claim 1, wherein the control of the lighting of the modules is slaved to the steering angle of the vehicle, so that the modules with horizontal cutoff situated towards the outside are progressively switched on when the vehicle follows a bend on the inside of which the headlight in question is situated.

15. A motor vehicle headlight module for a cutoff beam, comprising a plurality of light modules, each of said plurality of light modules comprising:

a concave reflector;

a light source disposed in said concave reflector; said light source comprising at least one light emitting diode, said diode being situated in a vicinity of an internal focus of the concave reflector;

a lens situated in front of said concave reflector and facing said light source and said concave reflector;

said concave reflector being associated with a bender situated between said reflector and said lens, a top face of which is reflective in order to receive a beam of light from said light source and bend said beam coming from said concave reflector, said bender further comprising a front end edge adapted to form the cutoff beam from the lighting beam;

said plurality of light modules comprising at least one first light module and at least one adjacent module, an exit surface of said at least one first one of said plurality of light modules having a substantially continuous surface with an exit surface of at least one lens of at least one adjacent module, wherein:

a mid-line of the lens and said at least one adjacent module lie in an arc of a skew curve; and a correcting optical system situated between said concave reflector and the lens for obtaining a desired cutoff line defined by a geometry of an entry face and an exit face of the lens, said correcting optical system further being situated between said front end edge of said bender and said lens.

16. The motor vehicle headlight module according to claim 15, wherein said exit face of the lens is obtained by sliding, along the skew curve arc, a forwardly convex arc situated in vertical planes.

17. The motor vehicle headlight module according to claim 16, wherein the forwardly convex arc that is made to slide in order to obtain the exit face of the lens is an arc of a circle situated in a vertical plane.

18. The motor vehicle headlight module according to claim 15, wherein said entry face of the lens is obtained by a sliding, similar to that of the exit face, of a second arc of a curve calculated so that the lens is stigmatic in each of said vertical planes between a point situated at a rear of the top of the lens on the optical axis and infinity.

19. The motor vehicle headlight module according to claim 15, wherein the skew curve arc constituting the approximation of a segment of the mid-line is seen from above in an arc of a circle and is seen in front view in another arc of a circle, each arc of a circle being an approximation of the plan view and of the front view of the associated segment of the mid-line, and admitting the same tangents to the ends.

20. The motor vehicle headlight module according to claim 15, wherein the angular extent of an arc of a circle constituting the approximation of a segment is no more than 90°.

* * * * *